US007552723B1

(12) United States Patent
Ugalde

(10) Patent No.: US 7,552,723 B1
(45) Date of Patent: Jun. 30, 2009

(54) TURBINE ASSEMBLY

(76) Inventor: Hector Ugalde, 9350 SW. 15 St., Miami, FL (US) 33174

( * ) Notice: Subject to any disclaimer, the term of this patent is extended or adjusted under 35 U.S.C. 154(b) by 0 days.

(21) Appl. No.: 12/123,862

(22) Filed: May 20, 2008

(51) Int. Cl.
*F02M 29/02* (2006.01)

(52) U.S. Cl. ..... 123/592; 48/189.5

(58) Field of Classification Search ..... 123/590, 123/592; 48/189.4, 189.5
See application file for complete search history.

(56) References Cited

U.S. PATENT DOCUMENTS

| | | | | | |
|---|---|---|---|---|---|
| 1,578,262 | A * | 3/1926 | Campbell | ..... | 48/189.5 |
| 1,778,790 | A * | 10/1930 | Brandl et al. | ..... | 48/189.4 |
| 3,932,567 | A * | 1/1976 | Skidmore | ..... | 261/30 |
| 3,942,500 | A * | 3/1976 | Koehm et al. | ..... | 123/591 |
| 5,113,838 | A * | 5/1992 | Kim | ..... | 123/592 |
| 6,158,412 | A * | 12/2000 | Kim | ..... | 123/306 |
| 6,536,420 | B1 * | 3/2003 | Cheng | ..... | 123/590 |
| 6,932,049 | B2 * | 8/2005 | Kim | ..... | 123/306 |
| 7,325,538 | B2 * | 2/2008 | Bean | ..... | 123/590 |
| 2003/0140892 | A1 * | 7/2003 | Kim | ..... | 123/306 |
| 2003/0150439 | A1 * | 8/2003 | Hsu | ..... | 123/592 |
| 2004/0031471 | A1 * | 2/2004 | Leuenberger | ..... | 123/590 |

* cited by examiner

*Primary Examiner*—Erick Solis
(74) *Attorney, Agent, or Firm*—Albert Bordas, P.A.

(57) ABSTRACT

A turbine assembly comprising a hub and a plurality of vanes. The hub has a plurality of slits angularly disposed thereon. The plurality of vanes, each comprises an interior edge and an exterior edge. Each of the plurality of vanes has curvature and trespasses the plurality of slits. Exterior edges on the plurality of vanes comprise at least two protrusions. The protrusions fill channels defined in an air intake line of an engine, thereby allowing the hub to spin within the air intake line to create a vortex.

14 Claims, 3 Drawing Sheets

TURBINE ASSEMBLY

BACKGROUND OF THE INVENTION

1. Field of the Invention

The present invention relates to engine components, and more particularly, to a turbine assembly for enhancing engine performance.

2. Description of the Related Art

The internal combustion engine is an engine in which the combustion of fuel and an oxidizer, typically air, occurs in a confined space called a combustion chamber. This exothermic reaction creates gases at high temperature and pressure, which are permitted to expand. The defining feature of an internal combustion engine is that useful work is performed by the expanding hot gases acting directly to cause movement of solid parts of the engine, by acting on pistons, rotors, or even by pressing on and moving the entire engine itself.

However, internal combustion engines are inefficient. There is a need to improve engine performance.

SUMMARY OF THE INVENTION

The instant invention is a turbine assembly, comprising a hub that has an interior wall and an exterior wall. The hub also has a plurality of slits angularly disposed thereon that extend from the interior wall to the exterior wall. The hub further comprises a front edge and a rear edge. In the preferred embodiment, the hub is cylindrical in shape.

The turbine assembly also comprises a plurality of vanes, each comprising an interior edge and an exterior edge. Each of the plurality of vanes has curvature and trespasses the plurality of slits so that the interior edge protrudes from the interior wall and the exterior edge protrudes from the exterior wall. Each of the exterior edges comprises at least two protrusions. The at least two protrusions fill channels defined in an air intake line of an engine, thereby allowing the hub to spin within the air intake line to create a vortex.

The vortex creates greater air pressure within the air intake line, which is supplied for the combustion of the fuel and oxidizer to improve engine performance. Each of the plurality of vanes is positioned in between the front edge and the rear edge. In the preferred embodiment, the air intake line extends from an air filter assembly and comprises a proximal end and a distal end. The hub and the plurality of vanes are located closer to the proximal end than to the distal end.

It is therefore one of the main objects of the present invention to provide a turbine assembly with means to produce a vortex for promoting greater engine performance.

It is another object of the present invention to provide a turbine assembly that creates greater air pressure within an air intake line, which is supplied for the combustion of the fuel and oxidizer to improve engine performance.

It is another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
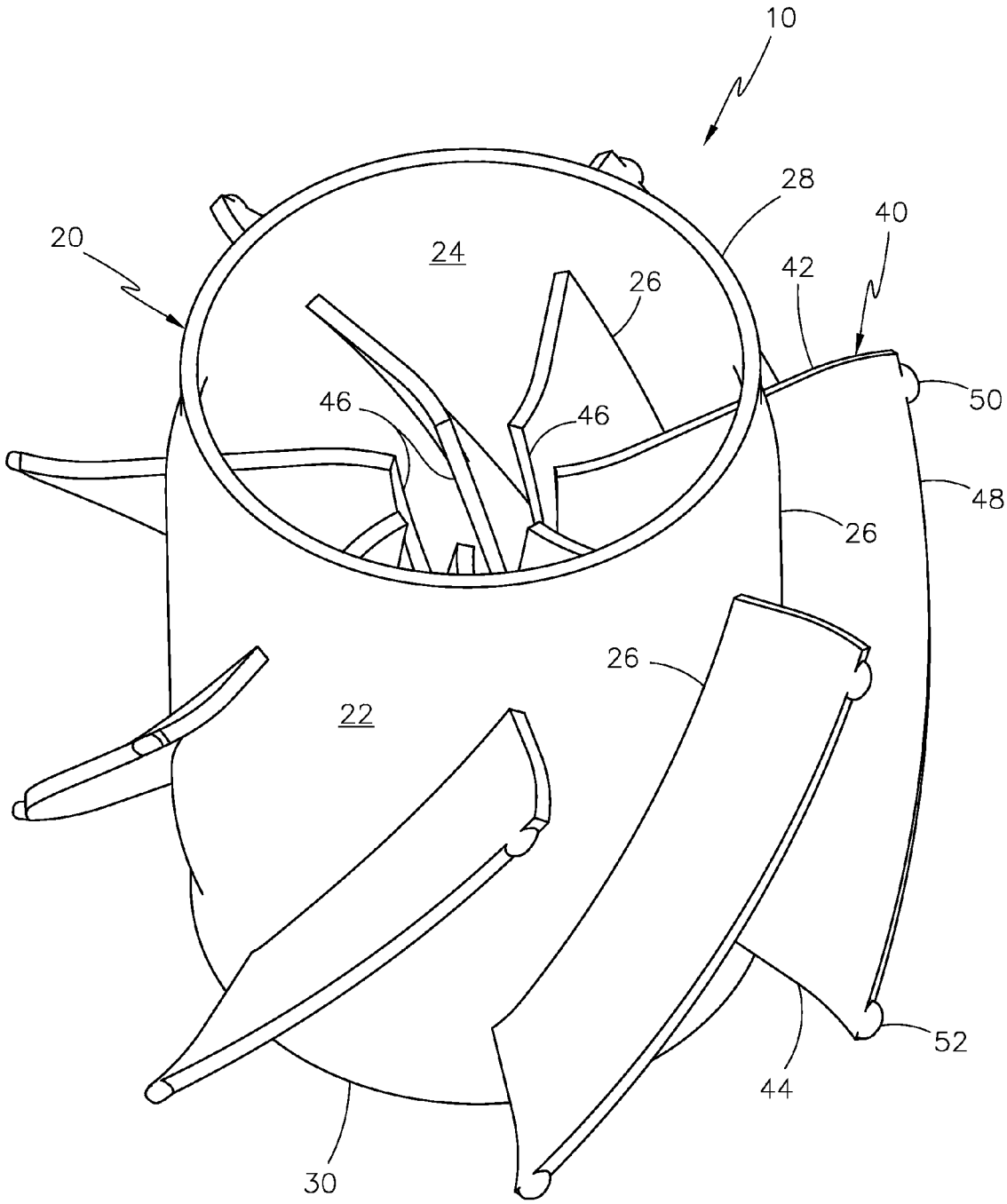
FIG. 1 represents an isometric view of the instant invention.

Referring now to the drawings, the present invention defines a turbine assembly and is generally referred to with numeral 10. It can be observed that it basically includes hub 20 and plurality of vanes 40.

As seen in FIG. 1, hub 20 has interior wall 24 and exterior wall 22. Hub 20 also has a plurality of slits 26 that are angularly disposed thereon. Slits 26 extend from interior wall 24 to exterior wall 22. Hub 20 further comprises front edge 28 and rear edge 30. In the preferred embodiment, hub 20 is cylindrical in shape. Turbine assembly 10 also comprises plurality of vanes 40, each comprising front edge 42, rear edge 44, interior edge 46, and exterior edge 48. Each of plurality of vanes 40 has curvature and trespasses the plurality of slits 26 so that interior edge 46 protrudes from interior wall 24 and exterior edge 48 protrudes from exterior wall 22. Each of the exterior edges 48 comprises at least front and rear protrusions 50 and 52 respectively, and each of the plurality of vanes 40 is positioned in between front edge 28 and rear edge 30.

Figure 2:
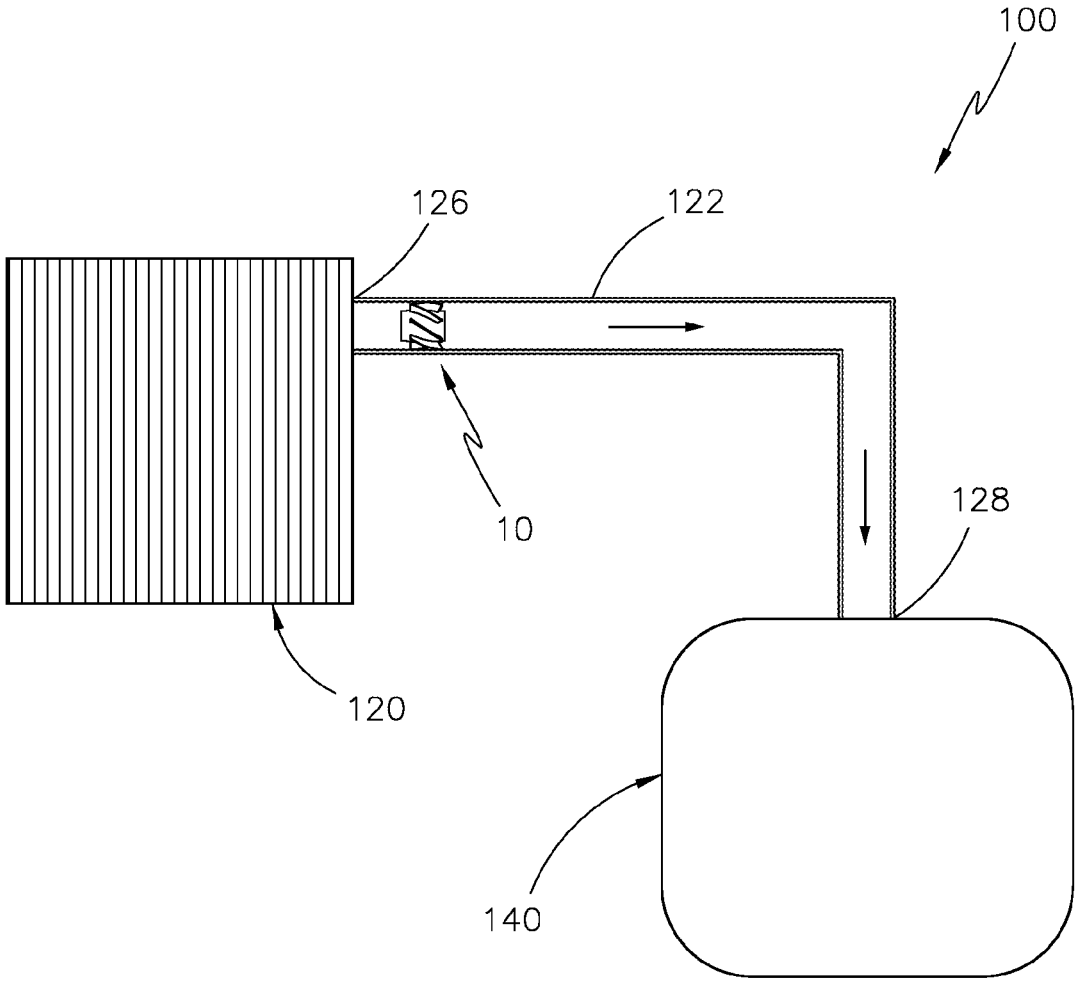
FIG. 2 is a schematic view of the instant invention fitted within an air intake line of an engine.

As seen in FIG. 2, in the preferred embodiment, air intake line 122 extends from air filter assembly 120 that comprises proximal end 126 and distal end 128. Hub 20 and plurality of vanes 40 are located closer to proximal end 126 than to distal end 128. Instant invention 10 is in position to allow hub 20 to spin within air intake line 122 to create a vortex. The vortex creates greater air pressure within air intake line 122, which is supplied for the combustion of fuel and oxidizer, typically air, to improve performance of engine 140 of engine assembly 100. More specifically, the air pressure in a vortex is lowest in the center where the speed is greatest, and rises progressively with distance from the center. This is in accordance with Bernoulli's Principle.

Figure 3:
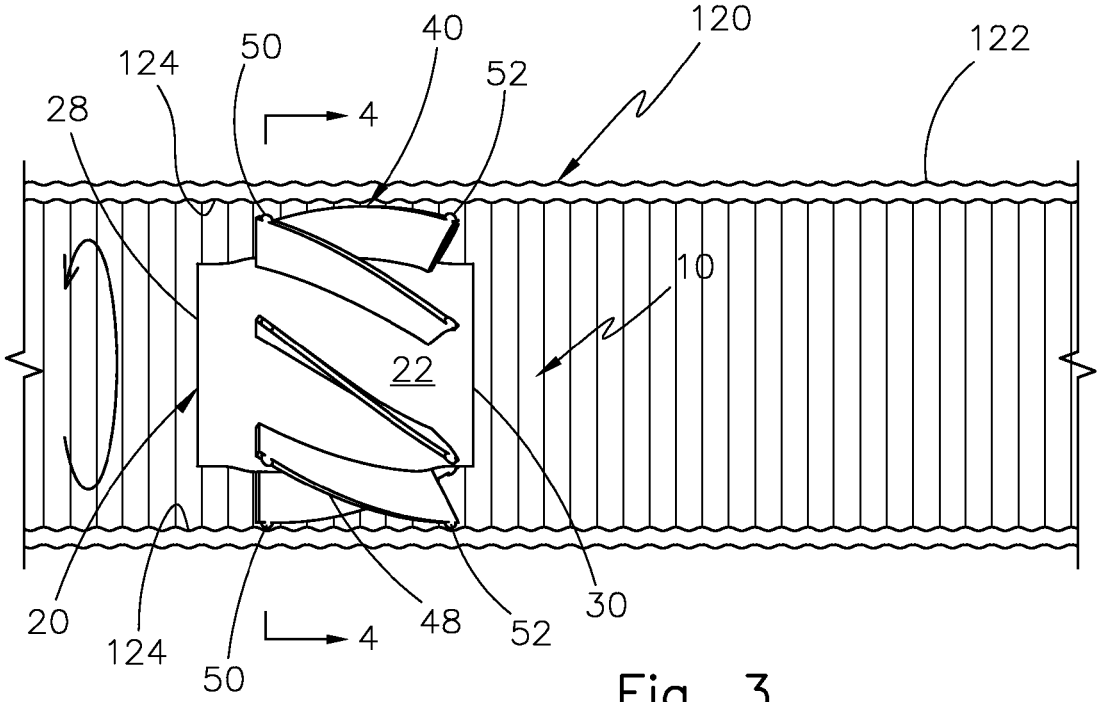
FIG. 3 is a cross sectional view of the instant invention fitted within the air intake line of the engine.
Figure 4:
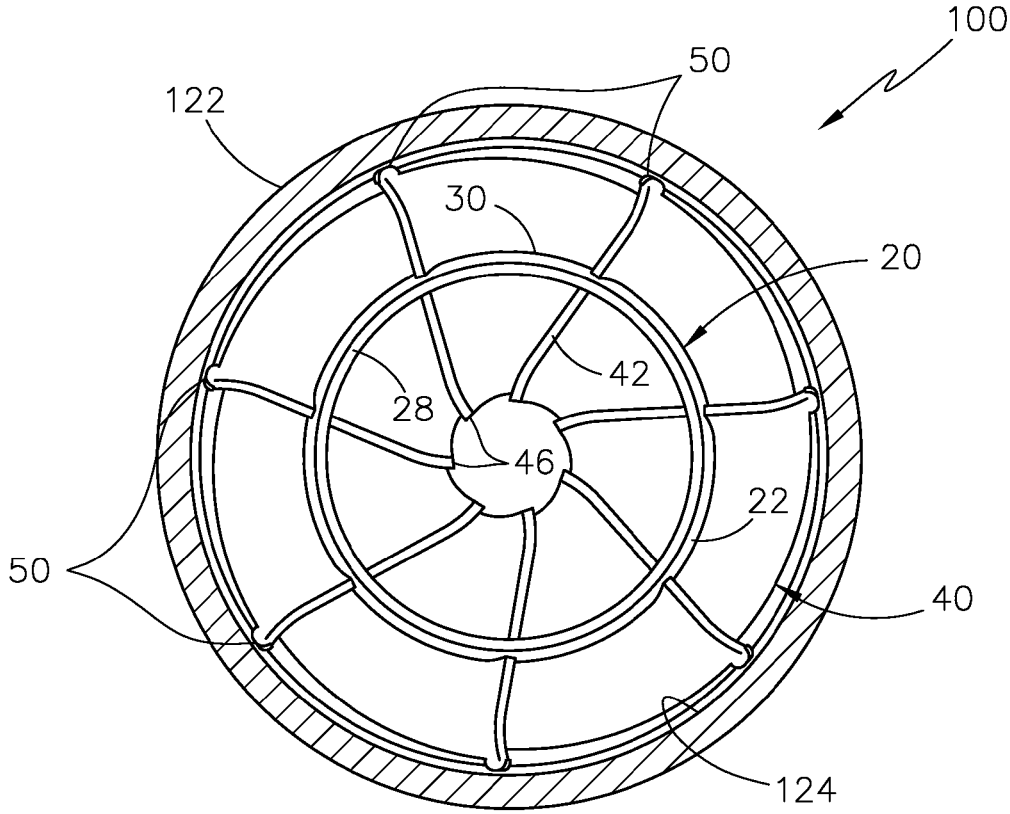
FIG. 4 is a cut view taken along the lines 4-4 as seen in FIG. 3, illustrating the instant invention fitted within the air intake line of the engine.

As seen in FIGS. 3 and 4, front and rear protrusions 50 and 52 respectively fill channels 124 defined in air intake line 122 of engine 140.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A turbine assembly, comprising:

A) a hub having an interior wall and an exterior wall, said hub also having a plurality of slits angularly disposed thereon that extend from said interior wall to said exterior wall; and B) a plurality of vanes, each comprising an interior edge and an exterior edge, each of said plurality of vanes having curvature and trespassing said plurality of slits so that said interior edge protrudes from said interior wall and said exterior edge protrudes from said exterior wall, each of said exterior edge comprises at least two protrusions, said at least two protrusions fill channels defined in an air intake line of an engine thereby allowing said hub to spin within said air intake line to create a vortex.

2. The turbine assembly set forth in claim 1, further characterized in that said hub further comprises a front edge and a rear edge.

3. The turbine assembly set forth in claim 2, further characterized in that said plurality of vanes are positioned in between said front edge and said rear edge.

4. The turbine assembly set forth in claim 1, further characterized in that said hub is cylindrical in shape.

5. The turbine assembly set forth in claim 1, further characterized in that said air intake line extends from an air filter assembly.

6. The turbine assembly set forth in claim 1, further characterized in that said air intake line comprises a proximal end and a distal end.

7. The turbine assembly set forth in claim 6, further characterized in that said hub and said plurality of vanes are located closer to said proximal end than to said distal end.

8. A turbine assembly, comprising:

A) a hub having an interior wall and an exterior wall, said hub also having a plurality of slits angularly disposed thereon that extend from said interior wall to said exterior wall, said hub further comprises a front edge and a rear edge; and B) a plurality of vanes, each comprising an interior edge and an exterior edge, each of said plurality of vanes having curvature and trespassing said plurality of slits so that said interior edge protrudes from said interior wall and said exterior edge protrudes from said exterior wall, each of said exterior edge comprises at least two protrusions, said at least two protrusions fill channels defined in an air intake line of an engine thereby allowing said hub to spin within said air intake line to create a vortex.

9. The turbine assembly set forth in claim 8, further characterized in that said plurality of vanes are positioned in between said front edge and said rear edge and said hub is cylindrical in shape.

10. The turbine assembly set forth in claim 8, further characterized in that said air intake line extends from an air filter assembly.

11. The turbine assembly set forth in claim 10, further characterized in that said air intake line comprises a proximal end and a distal end.

12. The turbine assembly set forth in claim 11, further characterized in that said hub and said plurality of vanes are located closer to said proximal end than to said distal end.

13. A turbine assembly, comprising:

A) a hub having an interior wall and an exterior wall, said hub also having a plurality of slits angularly disposed thereon that extend from said interior wall to said exterior wall, said hub further comprises a front edge and a rear edge, said hub is cylindrical in shape; and B) a plurality of vanes, each comprising an interior edge and an exterior edge, each of said plurality of vanes having curvature and trespassing said plurality of slits so that said interior edge protrudes from said interior wall and said exterior edge protrudes from said exterior wall, each of said exterior edge comprises at least two protrusions, said at least two protrusions fill channels defined in an air intake line of an engine thereby allowing said hub to spin within said air intake line to create a vortex, said plurality of vanes are positioned in between said front edge and said rear edge and, said air intake line extends from an air filter assembly, said air intake line comprises a proximal end and a distal end.

14. The turbine assembly set forth in claim 13, further characterized in that said hub and said plurality of vanes are located closer to said proximal end than to said distal end.

* * * * *